US011111923B2

(12) United States Patent
Dorsey

(10) Patent No.: US 11,111,923 B2
(45) Date of Patent: Sep. 7, 2021

(54) SYSTEM FOR PRIMING A POOL PUMP

(71) Applicant: Mark Thomas Dorsey, Asheville, NC (US)

(72) Inventor: Mark Thomas Dorsey, Asheville, NC (US)

( * ) Notice: Subject to any disclaimer, the term of this patent is extended or adjusted under 35 U.S.C. 154(b) by 59 days.

(21) Appl. No.: 16/564,461

(22) Filed: Sep. 9, 2019

(65) Prior Publication Data

US 2021/0071670 A1 Mar. 11, 2021

(51) Int. Cl.
*F04D 9/04* (2006.01)
*E04H 4/12* (2006.01)

(52) U.S. Cl.
CPC ..... *F04D 9/047* (2013.01); *E04H 4/12* (2013.01); *F04D 9/044* (2013.01)

(58) Field of Classification Search
CPC ... E04H 4/12; F04D 9/04; F04D 9/044; F04D 9/047; F04D 9/048
See application file for complete search history.

(56) References Cited

U.S. PATENT DOCUMENTS 2,386,275 A * 10/1945 Sigmund ..... F04D 9/042 415/18
2,758,547 A 8/1956 Wendell
3,578,880 A 5/1971 Cygnor
5,154,821 A 10/1992 Reid
5,620,309 A 4/1997 Todden
6,250,889 B1 6/2001 Shepard
6,792,915 B2 * 9/2004 Rembold ..... F02M 37/0052 123/446
7,334,600 B2 2/2008 Scott
7,931,447 B2 4/2011 Levin
8,573,952 B2 11/2013 Stiles
8,967,274 B2 3/2015 Al-Azzawi
9,605,680 B2 3/2017 Stiles
(Continued)

FOREIGN PATENT DOCUMENTS

FR 791915 * 6/1935
GB 407640 * 3/1934

OTHER PUBLICATIONS

Machine Translation: FR 791915A, Applicant: Sulzer AG, Dec. 19, 1935. (Year: 1935).*
(Continued)

*Primary Examiner* — Charles G Freay
(74) *Attorney, Agent, or Firm* — Steve LeBlanc, LLC

(57) ABSTRACT

A system for priming a pool pump includes piping that provides fluid communication to or from the pool pump. A valve is in fluid communication with the piping, and the valve has an open position that permits fluid flow through the valve and a shut position that prevents fluid flow through the valve. A priming pump is in fluid communication with the piping. The priming pump includes a suction and a discharge, and the suction of the priming pump connects to the piping upstream from the valve. A sensor generates a control signal reflective of time, fluid flow downstream from the priming pump, and/or fluid flow downstream from the pool pump. A controller receives the control signal, and when the control signal satisfies a predetermined criterion, the controller deenergizes the priming pump, repositions the valve to the open position, and/or energizes the pool pump.

17 Claims, 5 Drawing Sheets

(56) References Cited

U.S. PATENT DOCUMENTS

| | | | | |
|---|---|---|---|---|
| 2013/0058757 | A1 | 3/2013 | Johnson | |
| 2016/0096053 | A1* | 4/2016 | Beechy | A62C 37/36<br>169/46 |
| 2019/0249670 | A1* | 8/2019 | Dole | F04B 53/06 |

OTHER PUBLICATIONS

Priming Systems Operating & Maintenance, operating manual, Waterous Company, 125 Hardman Avenue South, South St. Paul, MI 55075; Apr. 7, 2017.

* cited by examiner

SYSTEM FOR PRIMING A POOL PUMP

FIELD OF THE INVENTION

The present invention generally involves a system for priming a pool pump. In particular embodiments, the system for priming the pool pump provides reliable operation and protects the pool pump from damage when the pool pump is remote from and/or above the waterline of the pool.

BACKGROUND OF THE INVENTION

Swimming pools are well-known in the art and generally include various components to circulate, filter, and treat the water in the pool. For example, FIG. 1 shows a conventional pool 10 that includes piping 12, a skimmer 14, a pool pump 16, a filter 18, and a heater 20. The piping 12 provides fluid communication between the various components, and the pool pump 16 draws pool water through the skimmer 14 and pumps the pool water through the filter 18 and heater 20 before returning the filtered and treated water to the pool 10.

The pool pump 16 is typically located near the pool 10 at an elevation that is no more than 1-2 feet above a waterline 22 of the pool 10 to ensure adequate suction head is available when starting and operating the pool pump 16. For some pool designs, however, it is desirable to locate the pool pump 16 remote from and/or higher than the waterline 22 of the pool 10. For example, pool pumps 16 create noise, and locating the pool pump 16 away from the pool 10 reduces the ambient noise in the vicinity of the pool 10. Alternately, for in-ground pools 10 installed in low-lying areas subject to flooding, locating the pool pump 16 at or below the waterline 22 of the pool 10 increases the risk of damage to the pool pump 16 due to flooding. In addition, local building codes and environmental regulations may prohibit locating the pool pump 16 below a local flood elevation unless the pool pump 16 is enclosed in a waterproof vault, and the costs associated with constructing and maintaining the waterproof vault may be substantial. Therefore, the need often arises to locate the pool pump 16 remote from and/or above the waterline 22 of the pool 10.

Many pool pumps 16 are not run continuously, and when the pool pump 16 is idle, unavoidable leaks in the piping 12 allow water in the piping 12 to drain to an elevation approximately level with the waterline 22 in the pool 10. As a result, locating the pool pump 16 remote from or above the pool 10 can result in insufficient suction head to start or run the pool pump 16. Therefore, the need exists for a system that will allow the pool pump 16 to be located remote from and/or above the waterline 22 of the pool 10 and still provide sufficient suction head to the pool pump 16.

BRIEF DESCRIPTION OF THE INVENTION

Aspects and advantages of the invention are set forth below in the following description, or may be obvious from the description, or may be learned through practice of the invention.

One embodiment of the present invention is a system for priming a pool pump that includes piping that provides fluid communication to or from the pool pump. A valve is in fluid communication with the piping, and the valve has an open position that permits fluid flow through the valve and a shut position that prevents fluid flow through the valve. A priming pump is in fluid communication with the piping. The priming pump includes a suction and a discharge, and the suction of the priming pump connects to the piping upstream from the valve. A sensor generates a control signal reflective of time, fluid flow downstream from the priming pump, and/or fluid flow downstream from the pool pump. A controller receives the control signal, and when the control signal satisfies a predetermined criterion, the controller deenergizes the priming pump, repositions the valve to the open position, and/or energizes the pool pump.

An alternate embodiment of the present invention is a system for priming a pool pump that includes piping that provides fluid communication to or from the pool pump. A valve is in fluid communication with the piping, and the valve has an open position that permits fluid flow through the valve and a shut position that prevents fluid flow through the valve. A priming pump is in fluid communication with the piping and includes a suction and a discharge. A first flow path exists through the valve when the valve is in the open position, and a second flow path exists through the priming pump when the valve is in the shut position. A sensor generates a control signal reflective of time, fluid flow downstream from the priming pump, and/or fluid flow downstream from the pool pump. A controller receives the control signal, and when the control signal satisfies a predetermined criterion, the controller deenergizes the priming pump, repositions the valve to the open position, and/or energizes the pool pump.

In yet another embodiment of the present invention, a system for priming a pool pump includes piping that provides fluid communication to or from the pool pump. A valve is in fluid communication with the piping, and the valve includes a first inlet and an outlet. The valve has an open position that permits fluid flow between the first inlet and the outlet and a shut position that prevents fluid flow between the first inlet and the outlet. A priming pump is in fluid communication with the piping. The priming pump includes a suction and a discharge, and the suction of the priming pump connects to the piping upstream from the first inlet of the valve. A controller is operably connected to the priming pump, the valve, or the pool pump, and when a predetermined criterion is met, the controller deenergizes the priming pump, repositions the valve to the open position, and/or energizes the pool pump.

Those of ordinary skill in the art will better appreciate the features and aspects of such embodiments, and others, upon review of the specification.

BRIEF DESCRIPTION OF THE DRAWINGS

A full and enabling disclosure of the present invention, including the best mode thereof to one skilled in the art, is set forth more particularly in the remainder of the specification, including reference to the accompanying figures, in which.

DETAILED DESCRIPTION OF THE INVENTION

Figure 1:
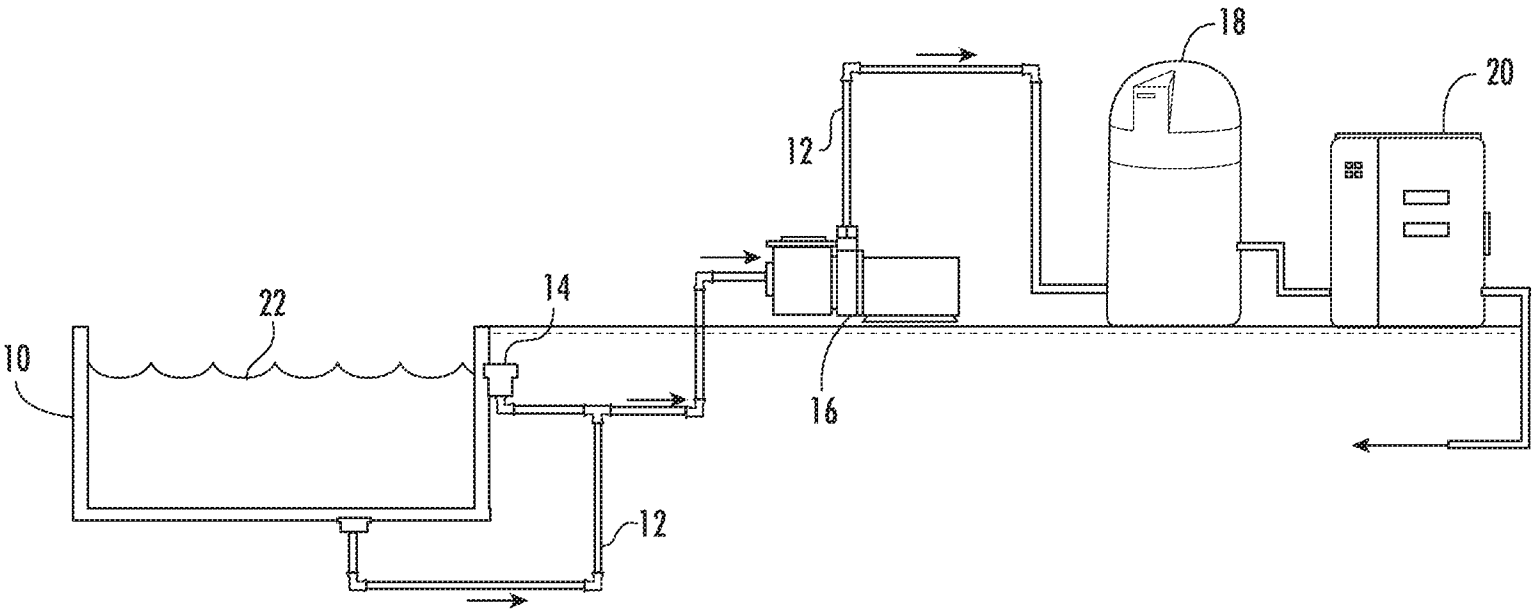
FIG. 1 is a piping diagram of a conventional pool installation.

Reference will now be made in detail to present embodiments of the invention, one or more examples of which are illustrated in the accompanying drawings. The detailed description uses numerical and letter designations to refer to features in the drawings. Like or similar designations in the drawings and description have been used to refer to like or similar parts of the invention. Each example is provided by way of explanation of the invention, not limitation of the invention. In fact, it will be apparent to those skilled in the art that modifications and variations can be made in the present invention without departing from the scope or spirit thereof. For instance, features illustrated or described as part of one embodiment may be used on another embodiment to yield a still further embodiment. Thus, it is intended that the present invention covers such modifications and variations as come within the scope of the appended claims and their equivalents.

As used in the claims, the definite article "said" identifies required elements that define the scope of embodiments of the claimed invention, whereas the definite article "the" merely identifies environmental elements that provide context for embodiments of the claimed invention that are not intended to be a limitation of any claim.

As used herein, the terms "first," "second," and "third" may be used interchangeably to distinguish one component from another and are not intended to signify location or importance of the individual components. As used herein, the term "fluid communication" refers to a fluid pathway, and components are in fluid communication with each other if a fluid pathway exists between the components. As used herein, the terms "upstream" and "downstream" refer to the location of items with reference to the direction of fluid flow in a fluid pathway. For example, item A is "upstream" from item B and item B is downstream from item A if fluid normally flows from item A to item B.

Embodiments of the present invention include a system for priming a pool pump that provides additional suction head to the pool pump, regardless of the elevation of the pool pump above the waterline of the pool. Embodiments of the present invention may be incorporated into the initial design of the pool to allow the pool pump to be located remote from and/or above the waterline of the pool. Alternately, embodiments of the present invention may be retrofitted to existing pool designs to enhance suction head to the pool pump, thereby reducing the potential for damage to the pool pump due to insufficient suction head.

Figure 2:
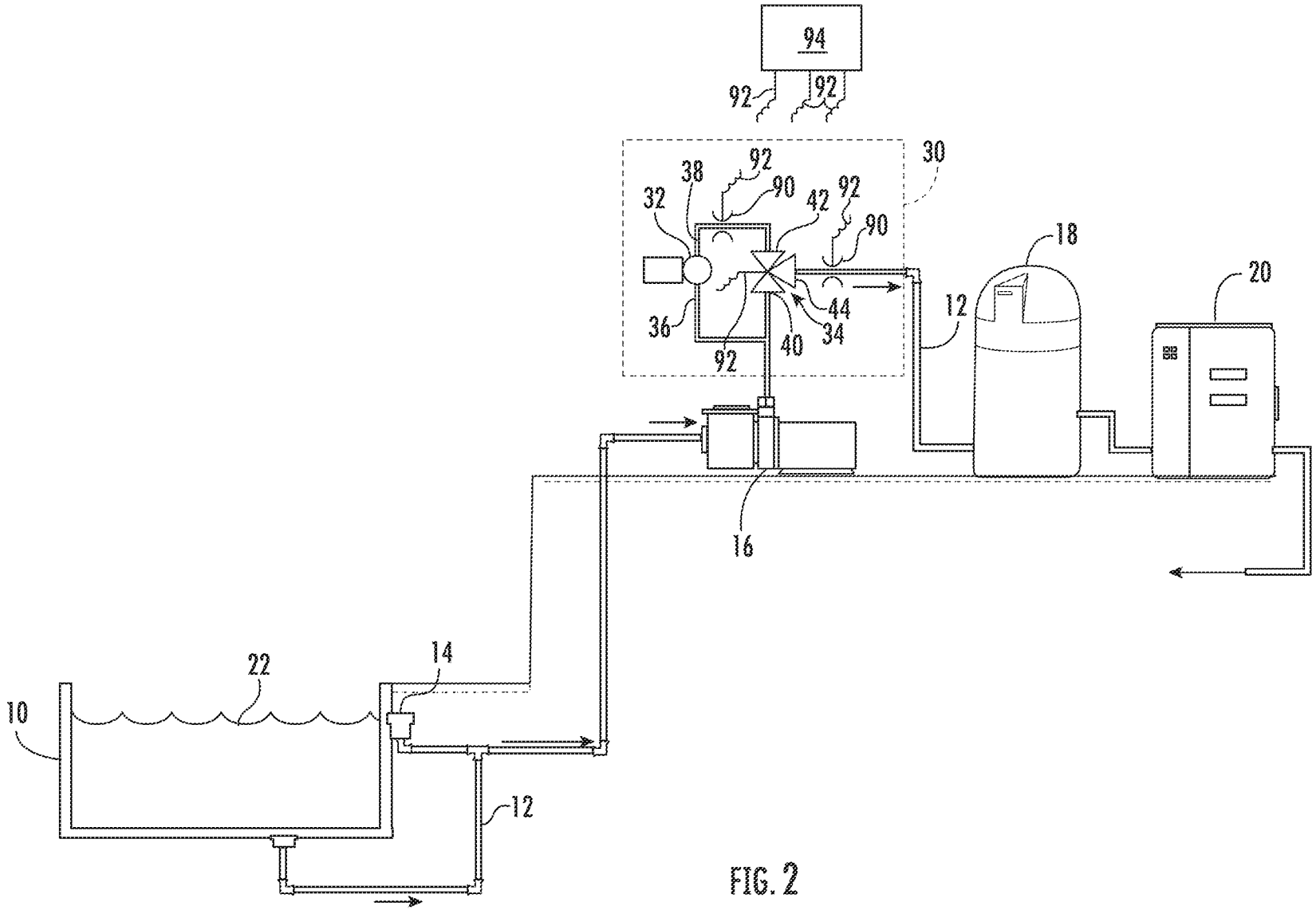
FIG. 2 is a piping diagram of a system for priming a pool pump according to a first embodiment of the present invention.
Figure 3:
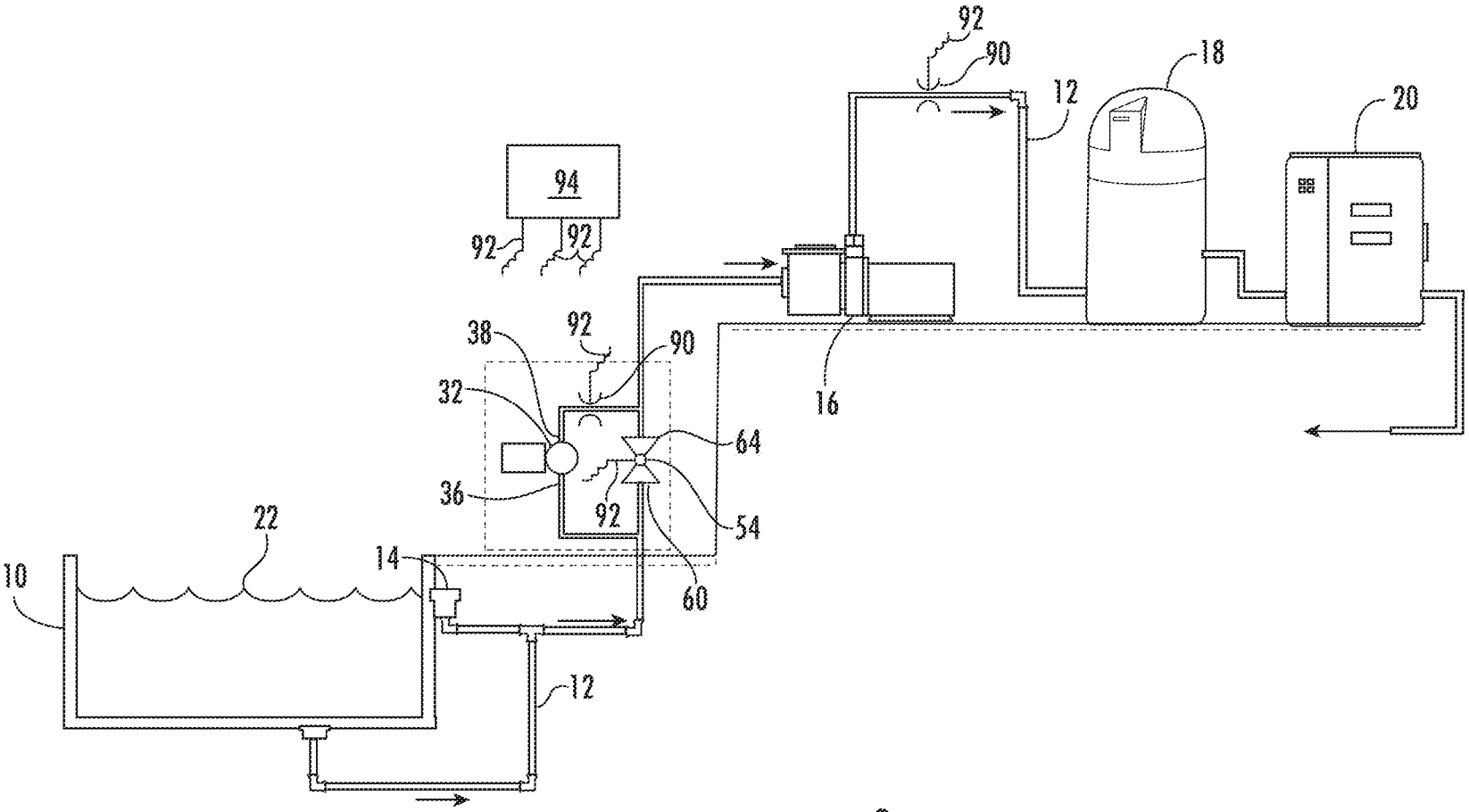
FIG. 3 is a piping diagram of a system for priming a pool pump according to a second embodiment of the present invention.
Figure 4:
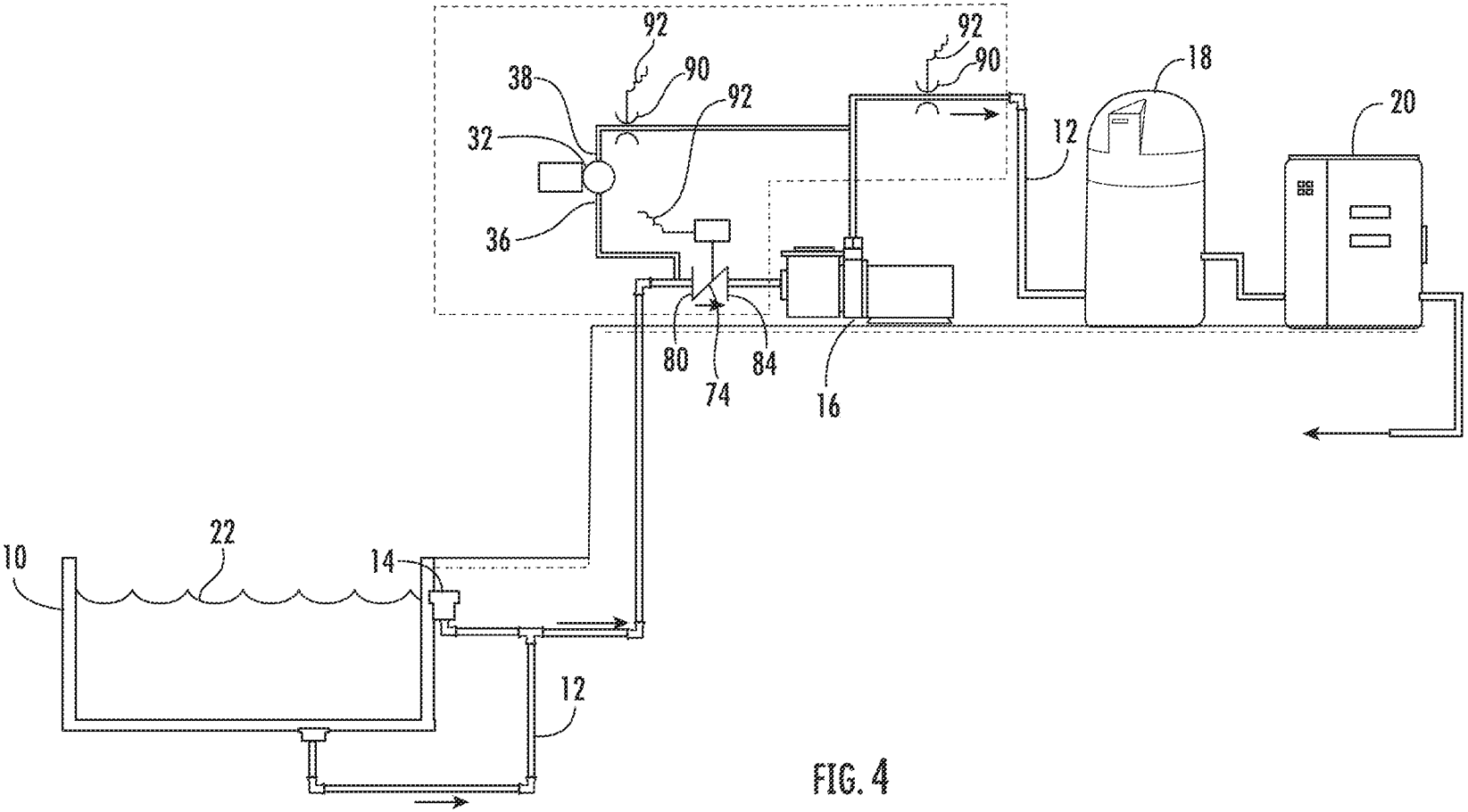
FIG. 4 is a piping diagram of a system for priming a pool pump according to a third embodiment of the present invention.

FIGS. 2-4 provide piping diagrams of a system 30 for priming a pool pump 16 according to various embodiments of the present invention. As shown in each figure, the pool 10 may generally include the piping 12 that provides fluid communication to and from the skimmer 14, pool pump 16, filter 18, and heater 20 to circulate, filter, and treat the water in the pool 10 as previously described with respect to FIG. 1. In contrast to the pool 10 shown in FIG. 1, the pool pump 16 shown in FIGS. 2-4 may be located remote from the pool 10 and at elevation above the waterline 22 of the pool 10. As a result, water in the pool pump 16 will drain by gravity when the pool pump 16 is idle, preventing operation of the pool pump 16 until sufficient water and suction head is again provided to the pool pump 16.

For the particular embodiment shown in FIG. 2, the system 30 for priming the pool pump 16 may include a priming pump 32 and a 3-way valve 34 in fluid communication with the piping 12 downstream from the pool pump 16. The priming pump 32 may be a diaphragm pump, a centrifugal pump, or any other type of pump capable of drawing a column of water up to the pool pump 16. The priming pump 32 generally includes a suction 36 and a discharge 38 that connect to the piping 12 to provide fluid communication to and from the piping 12. The 3-way valve 34 may be any locally or remotely operated valve that includes a first inlet 40, a second inlet 42, and an outlet 44.

As shown in FIG. 2, the suction 36 of the priming pump 32 may connect to the piping 12 upstream from the first inlet 40 of the 3-way valve 34, and the discharge 38 of the priming pump 32 may connect to the piping 12 upstream from the second inlet 42 to the 3-way valve 34. In this particular configuration, the 3-way valve 34 has an open position that permits fluid flow between the first inlet 40 and the outlet 44. The open position thus provides a first or normal flow path for water when the pool pump 16 is operating and the priming pump 32 is idle. The 3-way valve 34 also has a shut position that prevents fluid flow between the first inlet 40 and the outlet 44, while allowing fluid flow from the second inlet 42 to the outlet 44. The shut position thus provides a second or bypass flow path for water through the priming pump 32 when the pool pump 16 is idle and the priming pump 32 is operating.

For the particular embodiment shown in FIG. 3, the system 30 for priming the pool pump 16 includes the priming pump 32, as previously described with respect to FIG. 2, and a 2-way valve 54 in fluid communication with the piping 12 upstream from the pool pump 16. The 2-way valve 54 may be any locally or remotely operated valve that includes an inlet 60 and an outlet 64. As shown in FIG. 3, the suction 36 of the priming pump 32 may connect to the piping 12 upstream from the inlet 60 of the 2-way valve 54, and the discharge 38 of the priming pump 32 may connect to the piping 12 downstream from the outlet 64 of the 2-way valve 54. In this particular configuration, the 2-way valve 54 has an open position that permits fluid flow between the inlet 60 and the outlet 64. The open position thus provides a first or normal flow path for water when the pool pump 16 is operating and the priming pump 32 is idle. The 2-way valve 54 also has a shut position that prevents fluid flow between the inlet 60 and the outlet 64. The shut position thus provides a second or bypass flow path for water through the priming pump 32 when the pool pump 16 is idle and the priming pump 32 is operating.

For the particular embodiment shown in FIG. 4, the system 30 for priming the pool pump 16 includes the priming pump 32, as previously described with respect to FIG. 2, and a check valve 74 in fluid communication with the piping 12 upstream from the pool pump 16. The check valve 74 may be any valve having an inlet 80 and an outlet 84 that only permits flow through the check valve 74 from the inlet 80 to the outlet 84, while limiting or completely blocking flow through the check valve in the reverse direction from the outlet 84 to the inlet 80. As shown in FIG. 4, the suction 36 of the priming pump 32 may connect to the piping 12 upstream from the inlet 80 of the check valve 74, and the discharge 38 of the priming pump 32 may connect to the piping 12 downstream from both the outlet 84 of the check valve 74 and the pool pump 16. In this particular configuration, the check valve 74 has an open position that permits fluid flow between the inlet 80 and the outlet 84. The open position thus provides a first or normal flow path for water when the pool pump 16 is operating and the priming pump 32 is idle. The check valve 74 also has a shut position that prevents fluid flow between the inlet 80 and the outlet 84. The shut position thus provides a second or bypass flow path for water through the priming pump 32 when the pool pump 16 is idle and the priming pump 32 is operating.

As shown in FIGS. 2-4, the system 30 for priming the pool pump 16 may further include one or more sensors 90 that monitor an operating parameter and generate a control signal 92 that can be used to control the operation of the system 30. One of ordinary skill in the art will readily appreciate that the sensors 90 may include a timer, a flow sensor, a float valve, or any other sensor that can monitor an operating parameter in the system 30, and the present invention is not limited to any particular sensor unless specifically recited in the claims. For example, the sensor 90 may be a timer that monitors the operating status of the priming pump 32 or the position of the valve 34, 54, 74, and the control signal 92 may reflect the time that the priming pump 32 has been operating or the valve 34, 54, 74 has been shut. Alternately, as shown in FIGS. 2-4, the sensors 90 may be flow sensors or float switches located downstream from the priming pump 32 and/or the pool pump 16, and the control signal 92 may reflect the presence and/or volume of fluid flow downstream from the priming pump 32 or the pool pump 16.

A controller 94 may receive the control signal 92 generated by the sensor 90 and control the operation of the system 30 when the control signal 92 satisfies a predetermined criterion. The controller 94 may be a processor, a programmable logic controller (PLC), an application specific integrated circuit, or other computer-based system programmed to compare the control signal(s) 92 to the predetermined criterion to control the operation of the system 30. The predetermined criterion may be selected to indicate when sufficient water and/or suction head is present at the pool pump 16. For example, testing may determine an amount of time required for the priming pump 32 to draw water from the pool 10 to the pool pump 16, and the predetermined criterion may reflect a minimum amount of time that the priming pump 32 has been operating or the valve 34, 54, 74 has been in the shut position. As another example, the predetermined criterion may reflect a minimum flow rate of water downstream from the priming pump 32 and/or pool pump 16, confirming that sufficient water and/or suction head is present at the pool pump 16.

Figure 5:
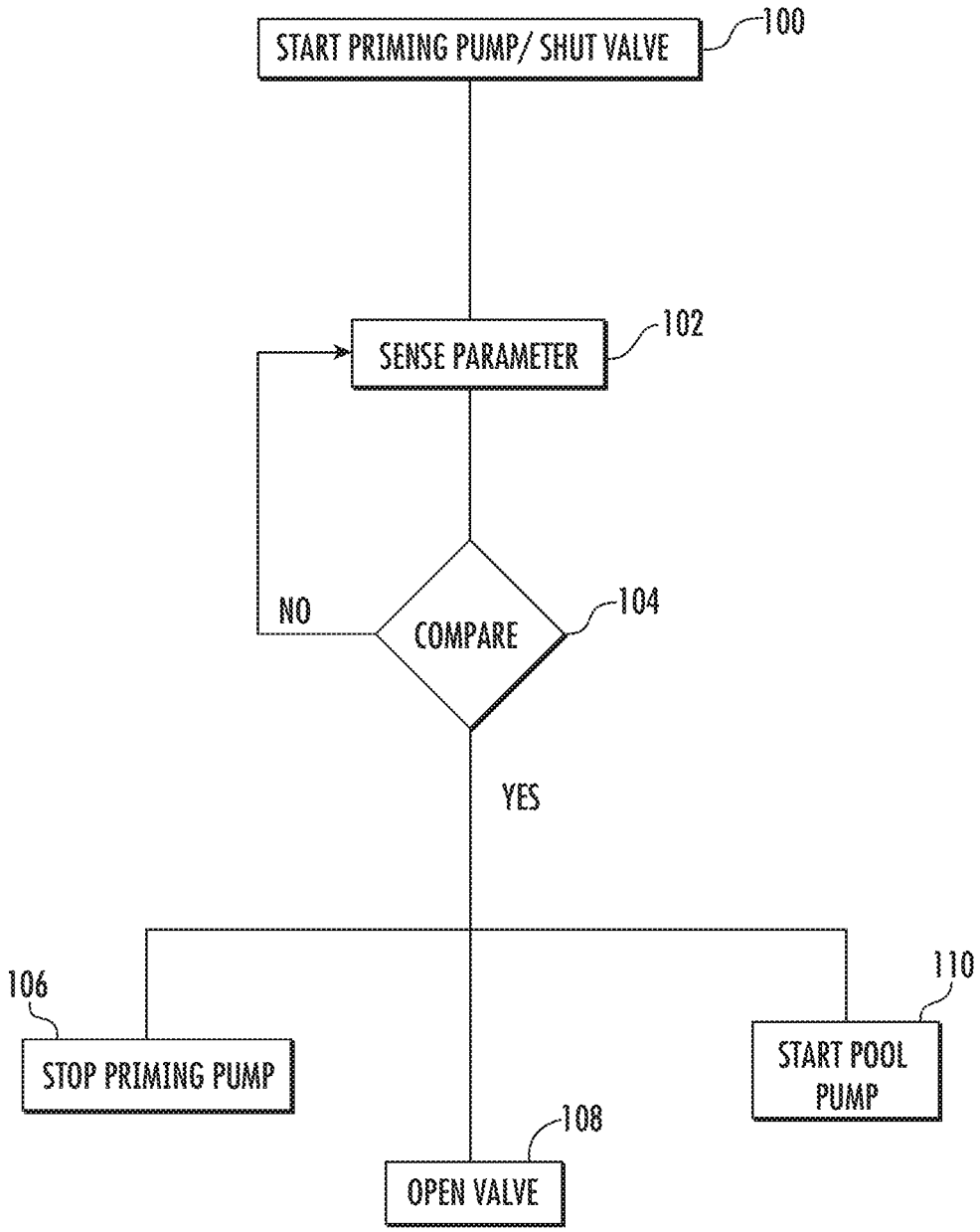
FIG. 5 is a flow diagram of logic for a controller according to one embodiment of the present invention.

FIG. 5 provides a flow diagram of logic for the controller 94 according to one embodiment of the present invention. At block 100, the priming pump 32 starts and the valve 34, 54, 74 shuts. The sensor 90 then monitors the selected operating parameter of the system 30 at block 102 and generates the control signal 92 that reflects the operating parameter being monitored. At block 104, the controller 94 compares the control signal 92 to the predetermined criterion. If the predetermined criterion is not satisfied, the logic returns to block 102 and continues monitoring the selected parameter. If the predetermined criterion is satisfied, indicating that sufficient water and/or suction head is present at the pool pump 16, the controller 94 proceeds with stopping the priming pump 32 (block 106), repositioning the valve 34, 54, 74 to open (block 108), and/or starting the pool pump 16 (block 110).

The system 30 for priming a pool pump 16 described and illustrated with respect to FIGS. 2-5 thus provides a cost-effective solution that can be incorporated into the initial pool 10 design or retrofitted into an existing pool 10 to allow the pool pump 16 to be located remote from the pool 10 and/or above the waterline 22 of the pool 10. The resulting pool 10 design may reduce ambient noise in the vicinity of the pool 10 and/or obviate the need to construct and maintain a waterproof enclosure for the pool pump 16.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal language of the claims.

What is claimed is:

1. A system for priming a pool pump, comprising:

piping that provides fluid communication to or from the pool pump;

a valve in fluid communication with said piping, wherein said valve has an open position that permits fluid flow through said valve and a shut position that prevents fluid flow through said valve;

a priming pump in fluid communication with said piping, wherein said priming pump comprises a suction and a discharge, and said suction of said priming pump directly connects to said piping at a first position upstream from said valve such that fluid flows from said first position to said valve when said valve is in said open position during operation of the pool pump;

a sensor that generates a control signal reflective of at least one of time, fluid flow downstream from said priming pump, or fluid flow downstream from the pool pump;

a controller that receives said control signal, and when said control signal satisfies a predetermined criterion, said controller at least one of deenergizes said priming pump, repositions said valve to said open position, or energizes the pool pump.

2. The system for priming a pool pump as in claim 1, wherein said suction of said priming pump connects to said piping at said first position upstream from the pool pump such that fluid flows from said first position to the pool pump during operation of the pool pump.

3. The system for priming a pool pump as in claim 1, wherein said suction of said priming pump connects to said piping at said first position downstream from the pool pump such that fluid flows from the pool pump to said first position during operation of the pool pump.

4. The system for priming a pool pump as in claim 1, wherein said discharge of said priming pump connects to said piping at a second position downstream from said valve such that fluid flows from said valve to said second position when said valve is in said open position during operation of the pool pump.

5. The system for priming a pool pump as in claim 1, wherein said discharge of said priming pump connects to said piping at a second position downstream from the pool pump such that fluid flows from the pool pump to said second position during operation of the pool pump.

6. The system for priming a pool pump as in claim 1, wherein said valve comprises a first inlet, a second inlet, and an outlet.

7. The system for priming a pool pump as in claim 6, wherein said discharge of said priming pump connects to said piping at a second position upstream from said second inlet to said valve such that fluid flows from said second position to said second inlet to said valve during operation of the pool pump.

8. A system for priming a pool pump, comprising:

piping that provides fluid communication to or from the pool pump;

a valve in fluid communication with said piping, wherein said valve has an open position that permits fluid flow through said valve and a shut position that prevents fluid flow through said valve;

a priming pump in fluid communication with said piping, wherein said priming pump comprises a suction and a discharge and said suction of said priming pump directly connects to said piping at a first position downstream from the pool pump such that fluid flows from the pool pump to said first position during operation of the pool pump;

a first flow path through said valve when said valve is in said open position;

a second flow path through said priming pump when said valve is in said shut position;

a sensor that generates a control signal reflective of at least one of time, fluid flow downstream from said priming pump, or fluid flow downstream from the pool pump;

a controller that receives said control signal, and when said control signal satisfies a predetermined criterion, said controller at least one of deenergizes said priming pump, repositions said valve to said open position, or energizes the pool pump.

9. The system for priming a pool pump as in claim 8, wherein said discharge of said priming pump connects to said piping at a second position downstream from the pool pump such that fluid flows from the pool pump to said second position during operation of the pool pump.

10. The system for priming a pool pump as in claim 8, wherein said valve comprises a first inlet, a second inlet, and an outlet.

11. The system for priming a pool pump as in claim 10, wherein said discharge of said priming pump connects to said piping at a second position upstream from said second inlet to said valve such that fluid flows from said second position to said second inlet to said valve during operation of the pool pump.

12. A system for priming a pool pump, comprising:

piping that provides fluid communication to or from the pool pump;

a valve in fluid communication with said piping, wherein said valve comprises a first inlet and an outlet, and said valve has an open position that permits fluid flow between said first inlet and said outlet and a shut position that prevents fluid flow between said first inlet and said outlet;

a priming pump in fluid communication with said piping, wherein said priming pump comprises a suction and a discharge, said suction of said priming pump connects to said piping at a first position upstream from said first inlet of said valve such that fluid flows from said first position to said first inlet of said valve when said valve is in said open position during operation of the pool pump, and said discharge of said priming pump directly connects to at least one of said piping downstream from said valve or said piping downstream from the pool pump;

a controller operably connected to at least one of said priming pump, said valve, or the pool pump, wherein when a predetermined criterion is met, said controller at least one of deenergizes said priming pump, repositions said valve to said open position, or energizes the pool pump.

13. The system for priming a pool pump as in claim 12, wherein said suction of said priming pump connects to said piping at said first position upstream from the pool pump such that fluid flows from said first position to the pool pump during operation of the pool pump.

14. The system for priming a pool pump as in claim 12, wherein said suction of said priming pump connects to said piping at said first position downstream from the pool pump such that fluid flows from the pool pump to said first position during operation of the pool pump.

15. The system for priming a pool pump as in claim 12, wherein said discharge of said priming pump connects to said piping at a second position downstream from said valve such that fluid flows from said valve to said second position during operation of the pool pump.

16. The system for priming a pool pump as in claim 12, wherein said discharge of said priming pump connects to said piping at a second position downstream from the pool pump such that fluid flows from the pool pump to said second position during operation of the pool pump.

17. The system for priming a pool pump as in claim 12, wherein said valve further comprises a second inlet, and said discharge of said priming pump connects to said piping at a second position upstream from said second inlet to said valve such that fluid flows from said second position to said second inlet to said valve during operation of the pool pump.

* * * * *